US011749199B1

(12) United States Patent
Pu et al.

(10) Patent No.: US 11,749,199 B1
(45) Date of Patent: Sep. 5, 2023

(54) PIXEL DRIVING CIRCUIT AND DISPLAY DEVICE

(71) Applicant: HKC Corporation Limited, Guangdong (CN)

(72) Inventors: Yang Pu, Guangdong (CN); Haijiang Yuan, Guangdong (CN)

(73) Assignee: HKC CORPORATION LIMITED, Guangdong (CN)

( * ) Notice: Subject to any disclaimer, the term of this patent is extended or adjusted under 35 U.S.C. 154(b) by 0 days.

(21) Appl. No.: 18/090,726

(22) Filed: Dec. 29, 2022

(30) Foreign Application Priority Data

May 19, 2022 (CN) ..... 202210545916.X

(51) Int. Cl.
*G09G 3/3233* (2016.01)
*G09G 3/36* (2006.01)

(52) U.S. Cl.
CPC ..... *G09G 3/3233* (2013.01); *G09G 3/36* (2013.01); *G09G 2300/0819* (2013.01); *G09G 2310/08* (2013.01); *G09G 2320/0247* (2013.01)

(58) Field of Classification Search
CPC ..... G09G 3/3233; G09G 3/36; G09G 2300/0819; G09G 2310/08; G09G 2320/0247
See application file for complete search history.

(56) References Cited

U.S. PATENT DOCUMENTS

| | | | | |
|---|---|---|---|---|
| 10,311,794 | B2 * | 6/2019 | Zhou | G09G 3/3258 |
| 11,074,864 | B1 * | 7/2021 | Lu | G09G 3/325 |
| 11,527,203 | B2 * | 12/2022 | Dong | G09G 3/3258 |
| 2018/0374410 | A1 * | 12/2018 | Zhu | G11C 19/28 |
| 2021/0150989 | A1 * | 5/2021 | Shi | G09G 3/3233 |
| 2021/0225254 | A1 | 7/2021 | Luan et al. | |
| 2022/0013066 | A1 | 1/2022 | Mao | |

FOREIGN PATENT DOCUMENTS

| | | | |
|---|---|---|---|
| CN | 102930824 | A | 2/2013 |
| CN | 106097964 | A | 11/2016 |
| CN | 113035133 | A | 6/2021 |

OTHER PUBLICATIONS

First Review Opinion dated Jan. 19, 2023 received in Chinese Patent Application No. CN 202210545916.X.

* cited by examiner

*Primary Examiner* — Jeff Piziali
(74) *Attorney, Agent, or Firm* — Scully, Scott, Murphy & Presser, P.C.

(57) ABSTRACT

A pixel driving circuit and a display device are provided. The pixel driving circuit is configured to drive a pixel unit to operate, and the pixel driving circuit includes a first compensation sub-circuit and a second compensation sub-circuit. The first compensation sub-circuit is configured to compensate a voltage of an anode of the pixel unit according to a reference signal and a data signal, and the second compensation sub-circuit is configured to compensate a leakage current generated by at least one transistor in the first compensation sub-circuit according to a leakage current generated by the second compensation sub-circuit.

18 Claims, 5 Drawing Sheets

PIXEL DRIVING CIRCUIT AND DISPLAY DEVICE

CROSS-REFERENCE TO RELATED APPLICATIONS

This application claims priority under 35 U.S.C. § 119(a) to Chinese Patent Application No. 202210545916X, filed May 19, 2022, the entire disclosure of which is incorporated herein by reference.

TECHNICAL FIELD

The disclosure relates to the technical field of display, in particular to a pixel driving circuit and a display device.

BACKGROUND

Display technology has always been one of important research directions in electronic devices. With development of photoelectric displaying technology and semiconductor manufacturing technology, display devices equipped with Thin Film Transistors (TFT), such as Liquid Crystal Displays (LCD) or Organic Light-Emitting Diodes (OLED), are becoming increasingly more mature.

At present, inconsistence in films at various positions of the TFT may occur in a manufacturing process of the TFT, which results in difference between threshold voltages of the TFT at the various positions, and thus display unevenness of the display device. Meanwhile, flicker may occur in the display device due to leakage currents in the TFT.

SUMMARY

In a first aspect, a pixel driving circuit for driving a pixel unit to operate is provided in the present disclosure. The pixel driving circuit includes a first compensation sub-circuit and a second compensation sub-circuit, the first compensation sub-circuit is configured to compensate a voltage of an anode of the pixel unit according to a reference signal and a data signal, and the second compensation sub-circuit is configured to compensate a leakage current generated by at least one transistor in the first compensation sub-circuit according to a leakage current generated by the second compensation sub-circuit. The first compensation sub-circuit includes a first transistor, a second transistor, a third transistor, a fourth transistor, a fifth transistor, a sixth transistor, an eighth transistor, and a first capacitor, and the second compensation sub-circuit includes a seventh transistor and a second capacitor; the first transistor has a gate configured to receive a first scanning signal, a first electrode configured to receive the data signal, and a second electrode electrically connected with a second electrode of the second transistor and with one end of the first capacitor; the second transistor has a gate configured to receive an enable signal and a first electrode configured to receive the reference signal; the third transistor has a gate configured to receive a second scanning signal, a first electrode configured to receive a first voltage signal, and a second electrode electrically connected with a second electrode of the eighth transistor and with one end of the second capacitor and the anode of the pixel unit; the fourth transistor has a gate electrically connected with a second electrode of the fifth transistor and with another end of the first capacitor and a first electrode of the seventh transistor, a first electrode configured to receive a second voltage signal, and a second electrode electrically connected with a first electrode of the eighth transistor and with a first electrode of the fifth transistor and a second electrode of the sixth transistor; the fifth transistor has a gate configured to receive the second scanning signal; the sixth transistor has a gate configured to receive a third scanning signal and a first electrode configured to receive the first voltage signal; the seventh transistor has a gate configured to receive the second scanning signal and a first electrode electrically connected with another end of the second capacitor; and the eighth transistor has a gate configured to receive the enable signal.

In a second aspect, a display device is provided in the present disclosure. The display device includes a pixel unit and a pixel driving circuit configured to drive the pixel units to operate. The pixel driving circuit includes a first compensation sub-circuit and a second compensation sub-circuit, the first compensation sub-circuit is configured to compensate a voltage of an anode of the pixel unit according to a reference signal and a data signal, and the second compensation sub-circuit is configured to compensate a leakage current generated by at least one transistor in the first compensation sub-circuit according to a leakage current generated by the second compensation sub-circuit. The first compensation sub-circuit includes a first transistor, a second transistor, a third transistor, a fourth transistor, a fifth transistor, a sixth transistor, an eighth transistor, and a first capacitor, and the second compensation sub-circuit includes a seventh transistor and a second capacitor; the first transistor has a gate configured to receive a first scanning signal, a first electrode configured to receive the data signal, and a second electrode electrically connected with a second electrode of the second transistor and with one end of the first capacitor; the second transistor has a gate configured to receive an enable signal and a first electrode configured to receive the reference signal; the third transistor has a gate configured to receive a second scanning signal, a first electrode configured to receive a first voltage signal, and a second electrode electrically connected with a second electrode of the eighth transistor and with one end of the second capacitor and the anode of the pixel unit; the fourth transistor has a gate electrically connected with a second electrode of the fifth transistor and with another end of the first capacitor and a first electrode of the seventh transistor, a first electrode configured to receive a second voltage signal, and a second electrode electrically connected with a first electrode of the eighth transistor and with a first electrode of the fifth transistor and a second electrode of the sixth transistor; the fifth transistor has a gate configured to receive the second scanning signal; the sixth transistor has a gate configured to receive a third scanning signal and a first electrode configured to receive the first voltage signal; the seventh transistor has a gate configured to receive the second scanning signal and a first electrode electrically connected with another end of the second capacitor; and the eighth transistor has a gate configured to receive the enable signal.

BRIEF DESCRIPTION OF THE DRAWINGS

In order to explain technical schemes in implementations of the present disclosure more clearly, accompanying drawings used in description of the implementations will be briefly introduced below. Obviously, the accompanying drawings in the following description are merely intended to be some implementations of the present disclosure, and other drawings can be obtained for those of ordinary skill in the art according to these accompanying drawings without paying creative efforts.

Reference numbers in the figures are as follows: first scan signal—G1(*n*+1), second scan signal—G2(*n*), third scan signal—G1(*n*), enable signal—EM(n), first voltage signal—VSS, second voltage signal—VDD, data signal—Vdata, reference signal—Vref, first electrode—a, second electrode—b, gate—g, pixel driving circuit—1, first compensation sub—circuit—11, second compensation sub—circuit—12, first transistor—T1, second transistor—T2, third transistor—T3, fourth transistor—T4, fifth transistor—T5, sixth transistor—T6, seventh transistor—T7, eighth transistor—T8, first capacitor—C1, second capacitor—C2, display device—2, housing—21, display panel—22, pixel unit—23, anode—231, cathode—232.

DETAILED DESCRIPTION

Technical schemes in implementations of the disclosure will be described clearly and completely in the following in combination with accompanying drawings in the implementations of the disclosure. Obviously, the described implementations are only a part, rather than all, of the implementations of this disclosure. On the basis of implementations in this disclosure, all other implementations obtained by those of ordinary skill in the art without paying creative efforts should fall within a protection scope of this disclosure.

Figure 1:
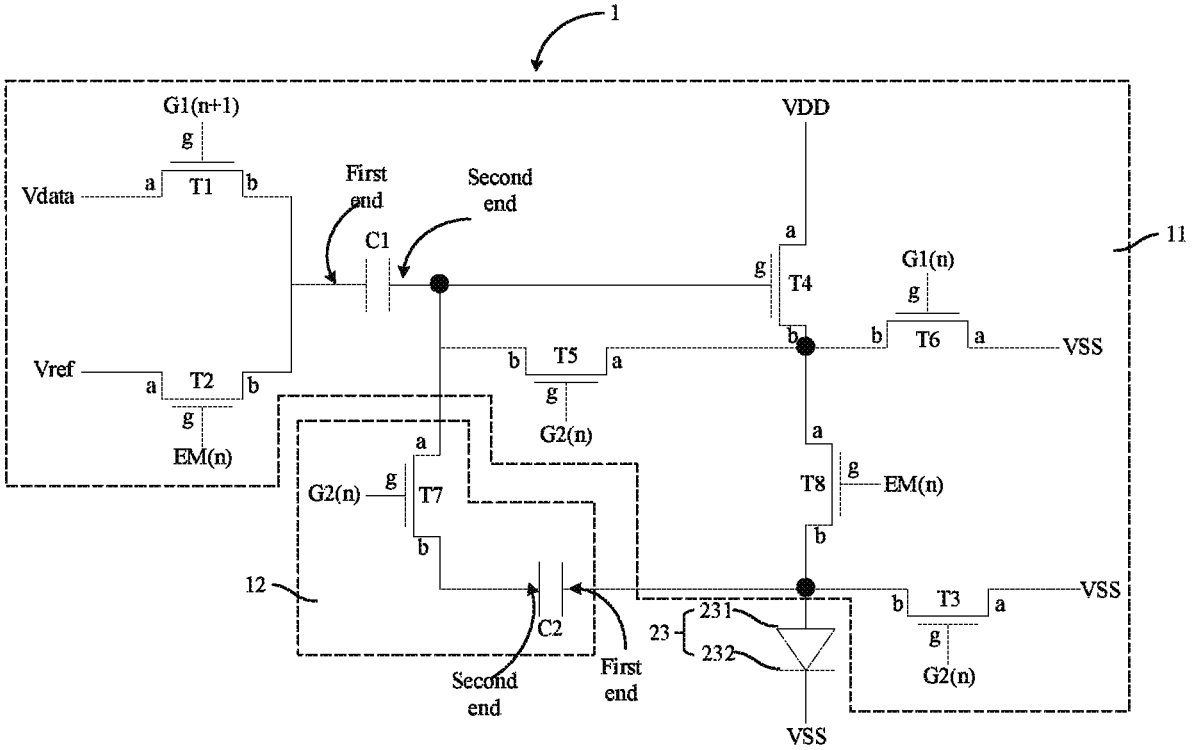
FIG. 1 is a schematic diagram of a pixel driving circuit provided in an implementation of the present disclosure.

A pixel driving circuit 1 for driving a pixel unit 23 to operate is provided in this disclosure. Reference is made to FIG. 1, which is a schematic diagram of a pixel driving circuit provided in an implementation of this disclosure. The pixel driving circuit 1 includes a first compensation sub-circuit 11 and a second compensation sub-circuit 12. The first compensation sub-circuit 11 is configured to compensate a voltage of an anode 231 of the pixel unit 23 according to a reference signal Vref and a data signal Vdata, and the second compensation sub-circuit 12 is configured to compensate a leakage current generated by at least one transistor in the first compensation sub-circuit 11 according to a leakage current generated by the second compensation sub-circuit 12.

Specifically, in this implementation, the first compensation sub-circuit 11 includes a first transistor T1, a second transistor T2, a third transistor T3, a fourth transistor T4, a fifth transistor T5, a sixth transistor T6, an eighth transistor T8, and a first capacitor C1, and the second compensation sub-circuit 12 includes a seventh transistor T7 and a second capacitor C2. The first transistor T1 has a gate g configured to receive a first scanning signal G1(*n*+1), a first electrode a configured to receive the data signal Vdata, and a second electrode b electrically connected with a second electrode b of the second transistor T2 and with a first end of the first capacitor C1. The second transistor has a gate g configured to receive an enable signal EM(n) and a first electrode a configured to receive the reference signal Vref. The third transistor T3 has a gate g configured to receive a second scanning signal G2(*n*), a first electrode a configured to receive a first voltage signal VSS, and a second electrode b electrically connected with a second electrode b of the eighth transistor T8 and with a first end of the second capacitor C2 and the anode 231 of the pixel unit 23. The fourth transistor T4 has a gate g electrically connected with a second electrode b of the fifth transistor T5 and with a second end of the first capacitor C1 and a first electrode a of the seventh transistor T7, a first electrode a configured to receive a second voltage signal VDD, and a second electrode b electrically connected with a first electrode a of the eighth transistor T8 and with a first electrode a of the fifth transistor T5 and a second electrode b of the sixth transistor T6. The fifth transistor T5 has a gate g configured to receive the second scanning signal G2(*n*). The sixth transistor T6 has a gate g configured to receive a third scanning signal G1(*n*) and a first electrode a configured to receive the first voltage signal VSS. The seventh transistor T7 has a gate g configured to receive the second scanning signal G2(*n*) and a first electrode a electrically connected with a second end of the second capacitor C2. The eighth transistor T3 has a gate g configured to receive the enable signal EM(n).

Figure 2:
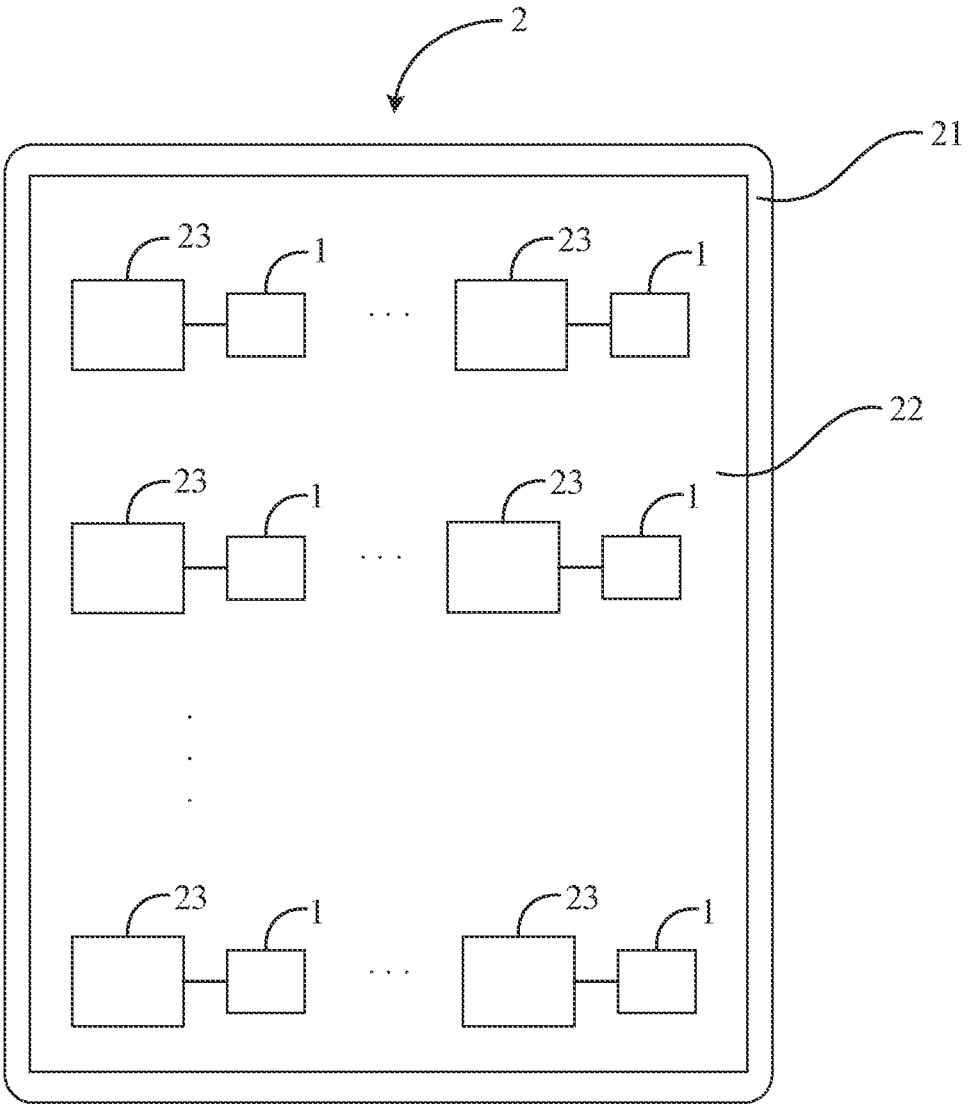
FIG. 2 is a top view of a display device provided in an implementation of the present disclosure.

It should be noted that, reference is made to FIG. 2, which is a top view of a display device provided in an implementation of the present disclosure. The pixel units 23 are generally arranged on the display panel 22 in an array, and each of the pixel units 23 is correspondingly provided with the pixel driving circuit 1 to drive the pixel units 23 to operate.

Specifically, on and off of the first transistor T1 is controlled by the first scanning signal G1(*n*+1), on and off of the third transistor T3, the fifth transistor T5, and the seventh transistor T7 is controlled by the second scanning signal G2(*n*), on and off of the sixth transistor T6 is controlled by the third scanning signal G1(*n*), and on and off of the second transistor T2 and the eighth transistor T8 is controlled by the enable signal EM(n). On and off of the fourth transistor T4 is controlled by a voltage at an end of the first capacitor C1 electrically connected with the gate g of the fourth transistor T4. As illustrated in FIG. 1, "n" represents a signal for driving a pixel unit 23 in a n-th row, and "n+1" represents a signal for driving a pixel unit 23 in the (n+1)-th row.

It can be understood that the first scanning signal G1(*n*+1), the second scanning signal G2(*n*), the third scanning signal G1(*n*) and the enable signal EM(n) can be generated and output by a timing signal generation module in the display device 2, or can be externally transmitted to the display panel 22. Similarly, the first voltage signal VSS and the second voltage signal VDD can be generated and output by a power module in the display device 2, or they can be signals transmitted to the display panel 22 by an external power supply, which is not limited in this disclosure.

Specifically, as illustrated in FIG. 1, a cathode 232 of the pixel unit 23 is configured to receive the first voltage signal VSS, that is, on and off states of respective transistors are controlled and a voltage of the anode 231 of the pixel unit 23 is initialized and compensated, at different times respectively by the first scanning signal G1(*n*+1), the second scanning signal G2(*n*), the third scanning signal G1(*n*), and the enable signal EM(n), so that a certain voltage difference is formed between the anode 231 and the cathode 232 of the pixel unit 23, and a current flowing through the pixel unit 23 is not affected by the second voltage signal VDD and a threshold voltage of a transistor.

It can be understood that in this implementation, the first compensation sub-circuit 11 is configured to compensate the voltage of the anode 231 of the pixel unit 23 according to the reference signal Vref and the data signal Vdata, which eliminates influence of the driving voltage signal for driving the pixel unit 23 to operate and a threshold voltage of a transistor on an operating current of the pixel unit 23, thus alleviating display unevenness of the display panel 22. Meanwhile, the second compensation sub-circuit 12 compensates a leakage current generated by at least one transistor in the first compensation sub-circuit 11 according to a leakage current generated by the second compensation sub-circuit 12, thereby alleviating flicker in the display panel 22 due to a leakage current.

Specifically, by controlling the transistors with respective signals, the influence of the second voltage signal VDD and a threshold voltage of a transistor on the operating current of the pixel unit 23 can be eliminated when the pixel unit 23 emits light, thereby alleviating the display unevenness of the display panel 22. Meanwhile, a leakage current of the seventh transistor T7 is configured to compensate a leakage current of the fifth transistor T5, thereby alleviating the flicker in the display panel 22 due to the leakage current.

Figure 3:
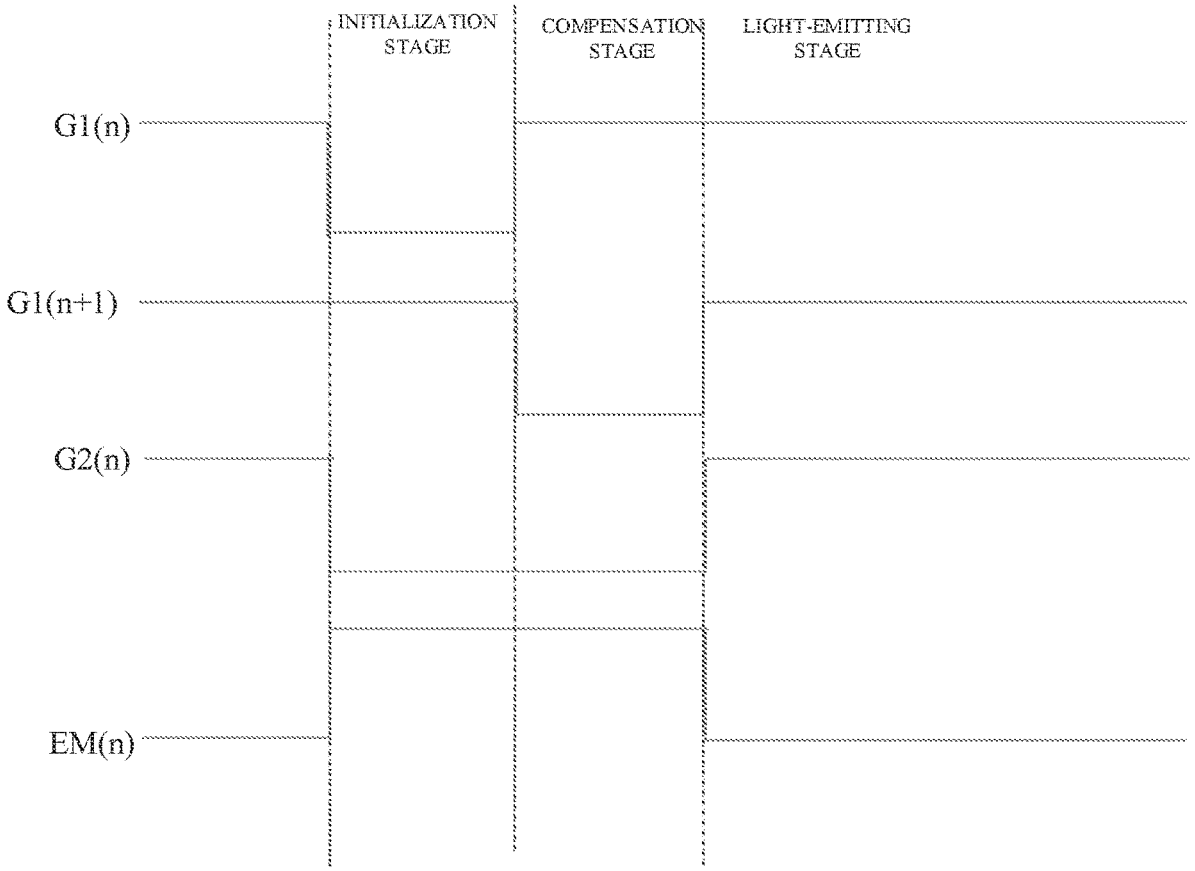
FIG. 3 is a schematic diagram of a timing signal provided in an implementation of the present disclosure.
Figure 4:
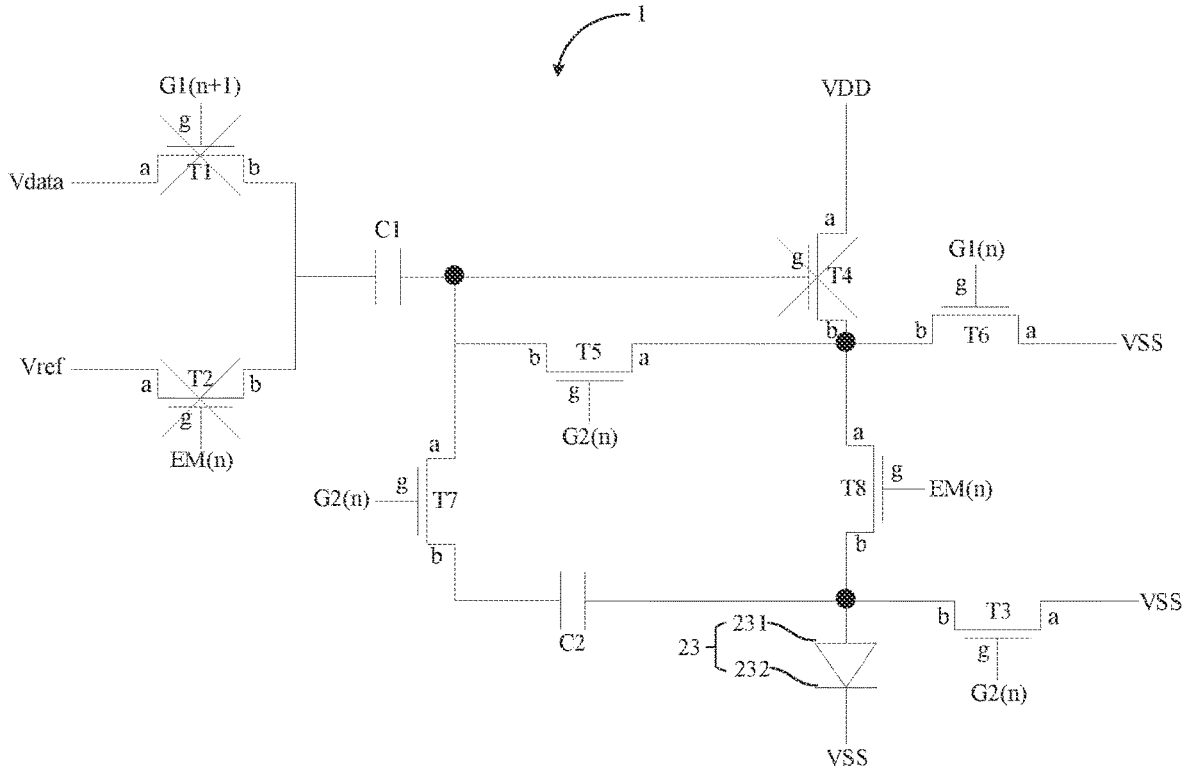
FIG. 4 is a schematic diagram of a pixel driving circuit in an initialization stage provided in an implementation of the present disclosure.

In a possible implementation, reference is made to FIG. 3 and FIG. 4 together. FIG. 3 is a schematic diagram of a timing signal provided in an implementation of the present disclosure; and FIG. 4 is a schematic diagram of a pixel driving circuit in an initialization stage provided in an implementation of the present disclosure. When the pixel driving circuit 1 is in the initialization stage, the third transistor T3, the fifth transistor T5, and the seventh transistor T7 are controlled to be turned on by the second scanning signal G2(*n*), and the sixth transistor T6 is controlled to be turned on by the third scanning signal G1(*n*), to make the anode 231 of the pixel unit 23 discharge to a voltage equal to a voltage of the first voltage signal VSS.

It should be noted that when the pixel unit 23 operates to display a picture, there is a certain voltage difference between the anode 231 and the cathode 232 of the pixel unit 23. When different pictures need to be displayed, the voltage difference between the anode 231 and the cathode 232 of the pixel unit 23 needs to be changed by the data signal Vdata. It can be understood that when the displayed picture changes, a voltage of the anode 231 of the pixel unit 23 for a previous frame may affect a voltage of the anode 231 of the pixel unit 23 for a next frame. Therefore, it is necessary to initialize the voltage of the anode 231 of the pixel unit 23 before the data signal Vdata charges the anode 231 of the pixel unit 23, so as to avoid influence of the previous frame on displaying of the next frame.

Specifically, as illustrated in FIGS. 3 and 4, the first scanning signal G1(*n*+1), the second scanning signal G2(*n*), the third scanning signal G1(*n*), and the enable signal EM(n) are at a high level or a low level at the same moment, respectively, so that the third transistor T3, the fifth transistor T5, the sixth transistor T6, and the seven transistor T7 are simultaneously turned on and other transistors are turned off to form a current loop, thereby discharging the voltage of the anode 231 of the pixel unit 23 through a current loop formed by the third transistor T3 to the voltage equal to the voltage of the first voltage signal VSS, and thus completing initialization of the anode 231 of the pixel unit 23. Similarly, a voltage at the first electrode a and the second electrode b of the fifth transistor T5 and a voltage at the second electrode b of the seventh transistor T7 are discharged through a current loop formed by the seventh transistor T7, the fifth transistor T5, and the sixth transistor T6 to a voltage equal to the voltage of the first voltage signal VSS, thus completing initialization of voltages across the first capacitor C1 and the second capacitor C2. The turned-off transistor is marked with an "X" in FIG. 4, and following "X" marks are the same, which will not be repeatedly described herein again.

It can be understood that the high level and the low level are relative concepts. In this implementation, the high level refers to a signal with a voltage ranging from 4V to 12V, and the low level refers to a signal with a voltage ranging from −2V to −6V. In other possible implementations, the voltage for the high level and the low level can be of other values, which is not limited in this disclosure.

Figure 5:
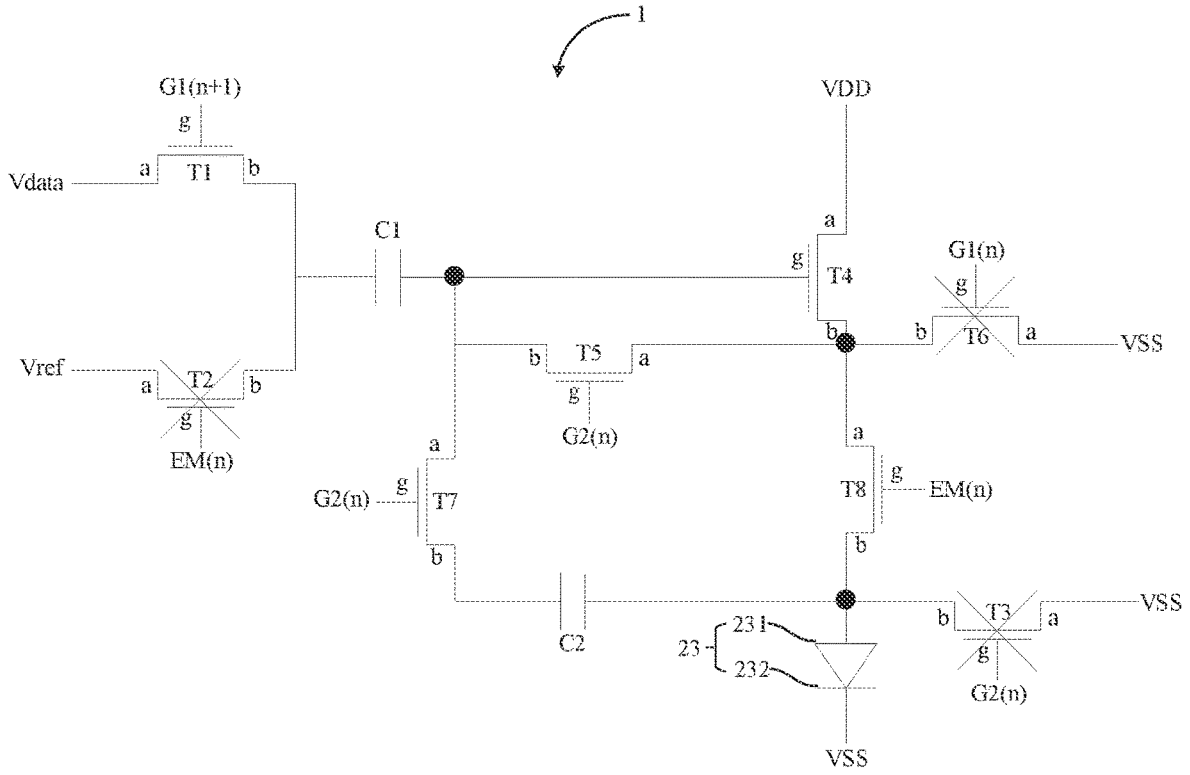
FIG. 5 is a schematic diagram of a pixel driving circuit in a compensation stage provided in an implementation of the present disclosure.

In a possible implementation, reference is made to FIG. 3 and FIG. 5 together, and FIG. 5 is a schematic diagram of a pixel driving circuit in a compensation stage provided in an implementation of the present disclosure. When the pixel driving circuit 1 is in the compensation stage, the first transistor T1 is controlled to be turned on by the first scanning signal G1(*n*+1), and the fifth transistor T5 and the seventh transistor T7 are controlled to be turned on by the second scanning signal G2(*n*), to charge the first end of the first capacitor C1 with the data signal Vdata and charge the second end of the first capacitor C1 with the second voltage signal VDD.

Specifically, after initialization of the voltage of the anode 231 and the voltages across the first capacitor C1 and the second capacitor C2 of the pixel unit 23, two ends of the first capacitor C1 and two ends of the second capacitor C2 need to be charged, so as to eliminate influence of the second voltage signal VDD, a threshold voltage of a transistor, and the leakage currents during the light-emitting stage of the pixel unit 23.

In this implementation, as illustrated in FIGS. 3 and 5, the first scanning signal G1(*n*+1), the second scanning signal G2(*n*), the third scanning signal G1(*n*), and the enable signal EM(n) are at high level or low level at the same moment, respectively, so that the first transistor T1, the fifth transistor T5 and the seventh transistor T7 are simultaneously turned on and other transistors are turned off to form a current loop, such that the data signal Vdata charges the first end of the first capacitor C1 through the first transistor T1, the second voltage signal VDD charges the second end of the first capacitor C1 through the fourth transistor T4 and the fifth transistor T5, and the second voltage signal VDD charges the second end of the second capacitor C2 through the seventh transistor T7.

In this implementation, a voltage across the first capacitor C1 satisfies $V_{C1}=V_{DD}-V_{th}-V_{data}$, where $V_{DD}$ is the voltage of the second voltage signal VDD, $V_{th}$ is a threshold voltage of the fourth transistor T4, and $V_{data}$ is a voltage of the data signal Vdata.

It should be noted that, in this implementation, the gate g of the fourth transistor T4 is electrically connected with the second end of the first capacitor C1, that is, on and off of the fourth transistor T4 is controlled by the voltage at the second end of the first capacitor C1. Specifically, since the voltage at the second end of the first capacitor C1 is initialized to be equal to the voltage of the first voltage signal VSS in the initialization stage, the fourth transistor T4 is firstly turned on in the compensation stage. As the second voltage signal VDD continues to charge the second end of the first capacitor C1, the voltage of the gate g of the fourth transistor T4 electrically connected with the one end of the first capacitor C1 continues to rise, and the fourth transistor T4 gradually changes from an on state to an off state. When the fourth transistor T4 is completely turned off, the second voltage signal VDD no longer charges the second end of the first capacitor C1. At this time, it can be known according to operating characteristics of the transistor that the voltage at the second end of the first capacitor C1 electrically connected with the gate g of the fourth transistor T4 is $V_{DD}-V_{th}$. It can be understood that since the data signal $V_{data}$ charges the first end of the first capacitor C1 to be equal to the voltage of the data signal $V_{data}$, the voltage across the first capacitor C1 satisfies $V_{C1}=V_{DD}-V_{th}-V_{data}$.

Similarly, the second voltage signal $V_{DD}$ also charges the second end of the second capacitor C2 to a voltage of $V_{DD}-V_{th}$ through the seventh transistor T7. Since the voltage at the first end of the second capacitor C2 is initialized to be equal to the voltage of the first voltage signal VSS in the initialization stage, it can be obtained that a voltage across the second capacitor C2 satisfies $V_{C2}=V_{DD}-V_{th}-V_{SS}$, where $V_{SS}$ is the voltage of the first voltage signal $V_{SS}$.

Figure 6:
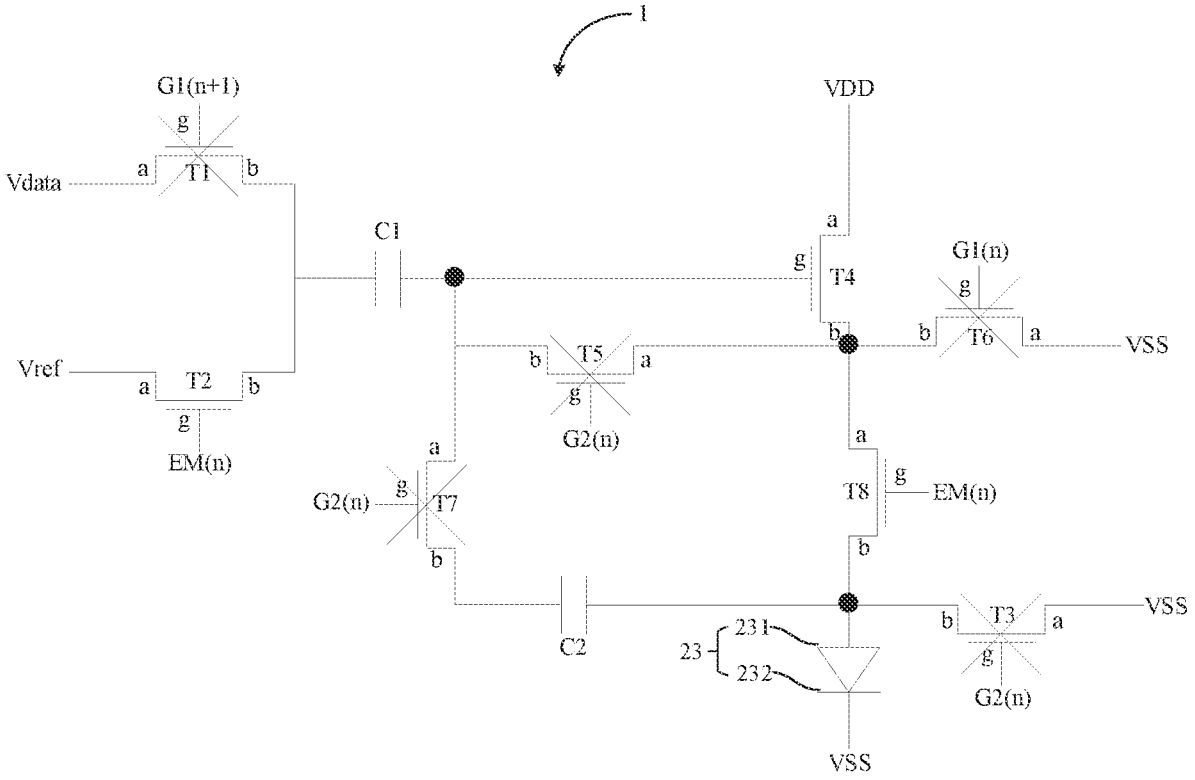
FIG. 6 is a schematic diagram of a pixel driving circuit in a light-emitting stage provided in an implementation of the present disclosure.

In a possible implementation, reference is made to FIG. 3 and FIG. 6 together, and FIG. 6 is a schematic diagram of a pixel driving circuit in a light-emitting stage provided in an implementation of the present disclosure. When the pixel driving circuit 1 is in the light-emitting stage, the second transistor T2 and the eighth transistor T8 are controlled to be turned on by the enable signal EM(n), to charge the first end of the first capacitor C1 with the reference signal Vref and charge the anode 231 of the pixel unit 23 with the second voltage signal $V_{DD}$ to make the pixel unit 23 emit light.

In this implementation, as illustrated in FIGS. 3 and 6, the first scanning signal G1(*n*+1), the second scanning signal G2(*n*), the third scanning signal G1(*n*) and the enable signal EM(n) are at high level or low level at the same moment, respectively, so that the second transistor T2 and the eighth transistor T8 are simultaneously turned on and other transistors are turned off to form a current loop, so that the reference signal Vref charges the first end of the first capacitor C1 through the second transistor T2 to make the voltage at the first end of the first capacitor C1 be equal to a voltage of the reference signal Vref. Due to coupling effect of capacitors, the voltage at the second end of the first capacitor C1 changes, with a value of $V_{DD}-V_{th}+(V_{ref}-V_{data})$, so that the fourth transistor T4 is turned on again, and a current generated under the second voltage signal $V_{DD}$ is transmitted to the pixel unit 23 through the fourth transistor T4 and the eighth transistor T8, so that the pixel unit 23 emits light.

In this implementation, a current flowing through the pixel unit 23 satisfies $I=\{V_{DD}-[V_{DD}-V_{th}+(V_{ref}-V_{data})]-V_{th}\}^2*k/2=(V_{data}-V_{ref})^2*k/2$, where $V_{ref}$ is the voltage of the reference signal and k is a constant.

Specifically, the fourth transistor T4 operates in a saturation region, and according to a current calculation formula of a transistor, it can be known that the current flowing through the pixel unit 23 satisfies $$I=(V_{SG}-V_{th})^2*k/2$$

$$=(V_{DD}-V_G-V_{th})^2*k/2$$

$$=\{V_{DD}-[V_{DD}-V_{th}+(V_{ref}-V_{data})]-V_{th}\}^2*k/2$$

$$=(V_{data}-V_{ref})^2*k/2$$

where $V_{SG}$ is a voltage difference between the first electrode a and the gate g of the fourth transistor T4, and $V_G$ is a voltage of the gate g of the fourth transistor T4. It can be understood that, in this implementation, the voltage across the first capacitor C1 is changed by the reference signal $V_{ref}$, so that the fourth transistor T4 operates in the saturation region, and thus influence of the voltage of the second voltage signal $V_{DD}$ and the threshold voltage of the fourth transistor T4 on the operating current flowing through the pixel unit 23 is eliminated, alleviating a technical problem of display unevenness of the display panel 22 caused by voltage drops of the second voltage signal $V_{DD}$ in different rows and different threshold voltages at different positions possibly caused by fabrication processes of transistors.

In this implementation, the voltage of the first electrode a of the seventh transistor T7 is greater than the voltage of the second electrode b of the seventh transistor T7.

It should be noted that since the fourth transistor T4 operates in the saturation region, the voltage of the gate g of the fourth transistor T4 is greater than the voltage of the second electrode b of the fourth transistor T4, the first electrode a of the fifth transistor T5 is electrically connected with the second electrode b of the fourth transistor T4, and the second electrode b of the fifth transistor T5 is electrically connected with the gate g of the fourth transistor T4, a leakage current from the second electrode b of the fifth transistor T5 to the first electrode a of the fifth transistor T5 can be generated, which reduces voltage retention capacity of the gate g of the fourth transistor T4 and affects the operating current flowing through the pixel unit 23.

Specifically, when the pixel unit 23 emits light, the voltage of the anode 231 of the pixel unit 23 rises to the operating voltage $V_{OLED}$ under action of the operating current and the first end of the second capacitor C2 is electrically connected with the anode 231 of the pixel unit 23, the voltage of the second end of the second capacitor C2 changes due to the coupling effect of capacitors, with a value of $V_{DD}-V_{th}+(V_{OLED}-V_{SS})$. It can be understood that because $V_{ref}-V_{data}<V_{OLED}-V_{SS}$, the voltage of the first electrode a of the seventh transistor T7 is greater than the voltage at the second electrode b of the seventh transistor T7, thus generating a compensation current flowing from the first electrode a of the seventh transistor T7 to the second electrode b of the seventh transistor T7, so as to compensate a leakage current flowing from the second electrode b of the fifth transistor T5 to the first electrode a of the fifth transistor T5, thereby improving the voltage retention capacity of the gate g of the fourth transistor T4, avoiding influence on the operating current flowing through the pixel unit 23, and alleviating flicker of the display panel 22.

In a possible implementation, the first electrode a is a source and the second electrode b is a drain. Alternatively, the first electrode a is the drain and the second electrode b is the source.

Specifically, a transistor is characterized in that under a voltage of the gate g, a channel is formed between the source and the drain, which are then connected with each other, so that the first electrode a can be the source and the second electrode b can be the drain; alternatively, the first electrode a may be the drain and the second electrode b may be the source, which is not limited in this disclosure.

In a possible implementation, the first transistor T1, the second transistor T2, the third transistor T3, the fourth transistor T4, the fifth transistor T5, the sixth transistor T6, the seventh transistor T7, and the eighth transistor T8 are each P-type low-temperature polysilicon thin film transistors.

In this implementation, the pixel unit 23 is an Organic Light-Emitting Diode (OLED), and a Low Temperature Poly-Silicon (LTPS) Thin Film Transistor (TFT) is usually adopted to drive the pixel unit 23.

It can be understood that with the LTPS-TFT being adopted to drive the pixel unit 23, the LTPS-TFT can be made to be with a small occupied space and to be thin due to a manufacturing process of the LTPS-TFT, thus reducing a thickness and weight of an entire display device 2. Meanwhile, less power is consumed by the LTPS-TFT than traditional TFTs.

Specifically, P-type LTPS-TFT is composed of a gate g and two P-type semiconductor parts cladded by an N-type semiconductor, one of the two P-type semiconductors is the source and the other of the two P-type semiconductors is the drain. The gate g is a metal electrode, and an insulating layer is arranged between the gate g and the source as well as the drain. Due to impurity of trivalent elements doped in P-type semiconductor material, a majority carrier in the P-type semiconductor is a hole, and the hole is positively charged. When a low level is applied to the gate g of the transistor, a channel is formed between two P-type semiconductors, and the source and drain of the transistor are connected with each other through the channel.

It can be understood that in other possible implementations, the first transistor T1, the second transistor T2, the third transistor T3, the fourth transistor T4, the fifth transistor T5, the sixth transistor T6, the seventh transistor T7, and the eighth transistor T8 can also be N-type LTPS-TFTs, or one part of them are N-type LTPS-TFTs and the other part of them are P-type LTPS-TFTs, which is not limited in this disclosure.

It can be understood that in this implementation, the pixel driving circuit 1 is adopted to drive the pixel unit 23 to operate, which eliminates influence of display unevenness of the pixel unit 23 due to inconsistent threshold voltages at various positions caused by a LTPS-TFT manufacturing process.

A display device 2 is provided in this disclosure. Referring to FIG. 2 again, the display device 2 includes pixel units 23 arranged in an array and the pixel driving circuit 1 as described above, and the pixel driving circuit 1 is configured to drive the pixel units 23 to operate. Specifically, the display device 2 further includes a housing 21 for carrying and mounting the display panel 22, and the pixel units 23 and the pixel driving circuit 1 are disposed on the display panel 22. Reference can be made to the above description for the pixel driving circuit 1, which will not be repeatedly described here again.

It can be understood that in this implementation, by controlling the transistors with respective signals, the influence of the second voltage signal $V_{DD}$ and the threshold voltage of the transistor on the operating current of the pixel unit 23 can be eliminated when the pixel unit 23 emits light, thereby alleviating the display unevenness of the display panel 22. Meanwhile, a leakage current of the seventh transistor T7 is configured to compensate a leakage current of the fifth transistor T5, thereby alleviating the flicker in the display panel 22 due to the leakage current.

Specific examples have been applied in this disclosure to explain principles and implementations of this disclosure. The description of the above implementations is only for helping to understand core ideas of this disclosure. At the same time, according to the ideas of this disclosure, changes in specific implementations and an application scope of this disclosure can be made by the ordinary skilled in this art. To sum up, Content of this specification should not be construed as limitation of this disclosure.

What is claimed is:

1. A pixel driving circuit for driving a pixel unit to operate, comprising:

a first compensation sub-circuit configured to compensate a voltage of an anode of the pixel unit according to a reference signal and a data signal; and a second compensation sub-circuit configured to compensate a leakage current generated by at least one transistor in the first compensation sub-circuit according to a leakage current generated by the second compensation sub-circuit;

wherein:

the first compensation sub-circuit comprises a first transistor, a second transistor, a third transistor, a fourth transistor, a fifth transistor, a sixth transistor, an eighth transistor, and a first capacitor, and the second compensation sub-circuit comprises a seventh transistor and a second capacitor;

the first transistor has a gate configured to receive a first scanning signal, a first electrode configured to receive the data signal, and a second electrode electrically connected with a second electrode of the second transistor and with one end of the first capacitor;

the second transistor has a gate configured to receive an enable signal and a first electrode configured to receive the reference signal;

the third transistor has a gate configured to receive a second scanning signal, a first electrode configured to receive a first voltage signal, and a second electrode electrically connected with a second electrode of the eighth transistor and with one end of the second capacitor and the anode of the pixel unit;

the fourth transistor has a gate electrically connected with a second electrode of the fifth transistor and with another end of the first capacitor and a first electrode of the seventh transistor, a first electrode configured to receive a second voltage signal, and a second electrode electrically connected with a first electrode of the eighth transistor and with a first electrode of the fifth transistor and a second electrode of the sixth transistor;

the fifth transistor has a gate configured to receive the second scanning signal;

the sixth transistor has a gate configured to receive a third scanning signal and a first electrode configured to receive the first voltage signal;

the seventh transistor has a gate configured to receive the second scanning signal and a first electrode electrically connected with another end of the second capacitor; and the eighth transistor has a gate configured to receive the enable signal.

2. The pixel driving circuit according to claim 1, wherein when the pixel driving circuit is in an initialization stage, the third transistor, the fifth transistor, and the seventh transistor are controlled to be turned on by the second scanning signal, and the sixth transistor is controlled to be turned on by the third scanning signal, to make the anode of the pixel unit discharge to a voltage equal to a voltage of the first voltage signal.

3. The pixel driving circuit according to claim 1, wherein when the pixel driving circuit is in a compensation stage, the first transistor is controlled to be turned on by the first scanning signal, and the fifth transistor and the seventh transistor are controlled to be turned on by the second scanning signal, to charge one end of the first capacitor with the data signal and charge another end of the first capacitor with the second voltage signal.

4. The pixel driving circuit according to claim 3, wherein a voltage across the first capacitor satisfies $V_{C1}=V_{DD}-V_{th}-V_{data}$, wherein $V_{DD}$ is a voltage of the second voltage signal, $V_{th}$ is a threshold voltage of the fourth transistor, and $V_{data}$ is a voltage of the data signal.

5. The pixel driving circuit according to claim 1, wherein when the pixel driving circuit is in a light-emitting stage, the second transistor and the eighth transistor are controlled to be turned on by the enable signal, to charge one end of the first capacitor with the reference signal and charge the anode of the pixel unit with the second voltage signal to make the pixel unit emit light.

6. The pixel driving circuit according to claim 5, wherein a current flowing through the pixel unit satisfies $I=\{V_{DD}-[V_{DD}-V_{th}+(V_{ref}-V_{data})]-V_{th}\}^2*k/2=(V_{data}-V_{ref})^2*k/2$, wherein $V_{ref}$ is a voltage of the reference signal and k is a constant.

7. The pixel driving circuit according to claim 5, wherein a voltage of the first electrode of the seventh transistor is greater than a voltage of the second electrode of the seventh transistor.

8. The pixel driving circuit according to claim 1, wherein the first transistor, the second transistor, the third transistor, the fourth transistor, the fifth transistor, the sixth transistor, the seventh transistor, and the eighth transistor are each a P-type low-temperature polysilicon thin film transistor.

9. The pixel driving circuit according to claim 1, wherein the first electrode is a source and the second electrode is a drain; or the first electrode is the drain and the second electrode is the source.

10. A display device, comprising a pixel unit and a pixel driving circuit configured to drive the pixel unit to operate; wherein the pixel driving circuit comprises:

a first compensation sub-circuit configured to compensate a voltage of an anode of the pixel unit according to a reference signal and a data signal; and a second compensation sub-circuit configured to compensate a leakage current generated by at least one transistor in the first compensation sub-circuit according to a leakage current generated by the second compensation sub-circuit;

wherein:

the first compensation sub-circuit comprises a first transistor, a second transistor, a third transistor, a fourth transistor, a fifth transistor, a sixth transistor, an eighth transistor, and a first capacitor, and the second compensation sub-circuit comprises a seventh transistor and a second capacitor;

the first transistor has a gate configured to receive a first scanning signal, a first electrode configured to receive the data signal, and a second electrode electrically connected with a second electrode of the second transistor and with one end of the first capacitor;

the second transistor has a gate configured to receive an enable signal and a first electrode configured to receive the reference signal;

the third transistor has a gate configured to receive a second scanning signal, a first electrode configured to receive a first voltage signal, and a second electrode electrically connected with a second electrode of the eighth transistor and with one end of the second capacitor and the anode of the pixel unit;

the fourth transistor has a gate electrically connected with a second electrode of the fifth transistor and with another end of the first capacitor and a first electrode of the seventh transistor, a first electrode configured to receive a second voltage signal, and a second electrode electrically connected with a first electrode of the eighth transistor and with a first electrode of the fifth transistor and a second electrode of the sixth transistor;

the fifth transistor has a gate configured to receive the second scanning signal;

the sixth transistor has a gate configured to receive a third scanning signal and a first electrode configured to receive the first voltage signal;

the seventh transistor has a gate configured to receive the second scanning signal and a first electrode electrically connected with another end of the second capacitor; and the eighth transistor has a gate configured to receive the enable signal.

11. The display device according to claim 10, wherein when the pixel driving circuit is in an initialization stage, the third transistor, the fifth transistor, and the seventh transistor are controlled to be turned on by the second scanning signal, and the sixth transistor is controlled to be turned on by the third scanning signal, to make the anode of the pixel unit discharge to a voltage equal to a voltage of the first voltage signal.

12. The display device according to claim 10, wherein when the pixel driving circuit is in a compensation stage, the first transistor is controlled to be turned on by the first scanning signal, and the fifth transistor and the seventh transistor are controlled to be turned on by the second scanning signal, to charge one end of the first capacitor with the data signal and charge another end of the first capacitor with the second voltage signal.

13. The display device according to claim 12, wherein a voltage across the first capacitor satisfies $V_{C1}=V_{DD}-V_{th}-V_{data}$, wherein $V_{DD}$ is a voltage of the second voltage signal, $V_{th}$ is a threshold voltage of the fourth transistor, and $V_{data}$ is a voltage of the data signal.

14. The display device according to claim 10, wherein when the pixel driving circuit is in a light-emitting stage, the second transistor and the eighth transistor are controlled to be turned on by the enable signal, to charge one end of the first capacitor with the reference signal and charge the anode of the pixel unit with the second voltage signal to make the pixel unit emit light.

15. The display device according to claim 14, wherein a current flowing through the pixel unit satisfies $I=\{V_{DD}-[V_{DD}-V_{th}+(V_{ref}-V_{data})]-V_{th}\}^2*k/2=(V_{data}-V_{ref})^2*k/2$, wherein $V_{ref}$ is a voltage of the reference signal and k is a constant.

16. The display device according to claim 14, wherein a voltage of the first electrode of the seventh transistor is greater than a voltage of the second electrode of the seventh transistor.

17. The display device according to claim 10, wherein the first transistor, the second transistor, the third transistor, the fourth transistor, the fifth transistor, the sixth transistor, the seventh transistor, and the eighth transistor are each a P-type low-temperature polysilicon thin film transistor.

18. The display device according to claim 10, wherein the first electrode is a source and the second electrode is a drain; or the first electrode is the drain and the second electrode is the source.

* * * * *